US010672583B1

(12) United States Patent
Whaley et al.

(10) Patent No.: US 10,672,583 B1
(45) Date of Patent: Jun. 2, 2020

(54) SHEET BEAM ELECTRON GUN USING AXIALLY-SYMMETRIC SPHERICAL CATHODE

(71) Applicant: L3 Electron Devices, Inc., Torrance, CA (US)

(72) Inventors: David R. Whaley, Rancho Palos Verdes, CA (US); Andrew P. Zubyk, San Carlos, CA (US)

(73) Assignee: L3 Electron Devices, Ind., Torrance, CA (US)

( * ) Notice: Subject to any disclaimer, the term of this patent is extended or adjusted under 35 U.S.C. 154(b) by 0 days.

(21) Appl. No.: 16/376,947

(22) Filed: Apr. 5, 2019

(51) Int. Cl.
*H01J 23/06* (2006.01)
*H01J 25/34* (2006.01)
*H01J 23/083* (2006.01)

(52) U.S. Cl.
CPC ..... *H01J 23/083* (2013.01); *H01J 23/06* (2013.01); *H01J 25/34* (2013.01)

(58) Field of Classification Search
CPC ..... H01J 23/083; H01J 23/06; H01J 25/34
USPC ..... 250/423 R, 424, 493.1
See application file for complete search history.

(56) References Cited

U.S. PATENT DOCUMENTS 4,205,254 A * 5/1980 Kanai ..... H01J 29/488 313/454
8,547,006 B1 * 10/2013 Ives ..... H01J 25/10 313/383
2010/0045160 A1 * 2/2010 Dayton, Jr. ..... H01J 23/04 313/414

* cited by examiner

*Primary Examiner* — Nicole M Ippolito
(74) *Attorney, Agent, or Firm* — Workman Nydegger

(57) ABSTRACT

Electron gun. The electron gun includes a circular cathode. The circular cathode comprises a spherical surface. The electron gun further includes a focus electrode. The focus electrode has four quadrants. The focus electrode is disposed about the circular cathode. The focus electrode includes four primary focus angle points. At least two of the four, adjacent, primary focus angle points have different angle values. Each of the four primary focus angle points is in a different quadrant. Focus angles on the focus electrode between any two primary focus angle points vary from one primary focus angle point to another primary focus angle point.

20 Claims, 6 Drawing Sheets

SHEET BEAM ELECTRON GUN USING AXIALLY-SYMMETRIC SPHERICAL CATHODE

BACKGROUND

Background and Relevant Art

Electron guns generate electron beams. The electron beams can be used for a variety of different purposes. For example, an electron beam can be used to generate microwaves by using the beam in a traveling wave tube (TWT) which outputs microwave emissions. Note that TWTs have a distinct circuit size for electron beams based on the frequency of the microwaves being emitted. Beams larger than this size can result in lost power and/or damage to surrounding items, as the beams can be quite powerful. That is, the electron beam must be limited in size, in at least one dimension, to be efficiently and safely used in a TWT. Further, because nearly all electron guns are based on circular cathodes with a spherical surface, designs for these guns have almost exclusively produced circular cross-sectional beams, meaning that the electron beams are limited in all dimensions which are transverse to the direction of beam propagation by the circuit.

However, if an asymmetrical (such as elliptical or rectangular) shaped electron beam could be used, higher power (or conversely lower voltage with the same power) could be obtained from the microwave generating TWT, as the beam would have the appropriate dimension for the circuit size in a first dimension to be used with the TWT, but could have the capability to add additional power, or lower voltage at the same power, by having a second dimension of the electron beam that is wider than the first dimension of the electron beam. The circuit might require modification due to the wider beam in the second dimension.

Prior approaches to asymmetric sheet beam formation use either non-axisymmetric elliptical cathodes or rectangular cathodes to create an elliptical-shaped or rectangular-shaped electron beam. Elliptical cathodes with an elliptical surface shape are exceedingly difficult to manufacture. The simple and well-known method to machine a spherical cathode shape using a lathe operation is no longer possible if an elliptical surface is required. In addition, the elliptical shape must be properly oriented in any electron gun, which is significantly more difficult than using a rotatable axisymmetric cathode. A further advantage of using an axisymmetric cathode is that the shape of the focus electrode surrounding the cathode is simpler to machine and align due to the circular cross section of the spherical cathode. A rectangular cathode with a single radius of curvature in just one direction is an alternate approach to create a sheet beam. Though this type of cathode is easier to manufacture than a cathode with an elliptical surface, it does not allow for electron beam compression in one of the two orthogonal directions, making it of limited utility in devices that require beam propagation along an appreciable distance.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

One embodiment illustrated herein comprises an electron gun. The electron gun includes a circular cathode. The circular cathode comprises a spherical surface. The electron gun further includes a focus electrode. The focus electrode has four quadrants. The focus electrode is disposed about the circular cathode. The focus electrode includes four primary focus angle points. At least two of the four, adjacent, primary focus angle points have different angle values. Each of the four primary focus angle points is in a different quadrant. Focus angles on the focus electrode between any two primary focus angle points vary from a one primary focus angle point to another primary focus angle point.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which.

DETAILED DESCRIPTION

Figure 1:
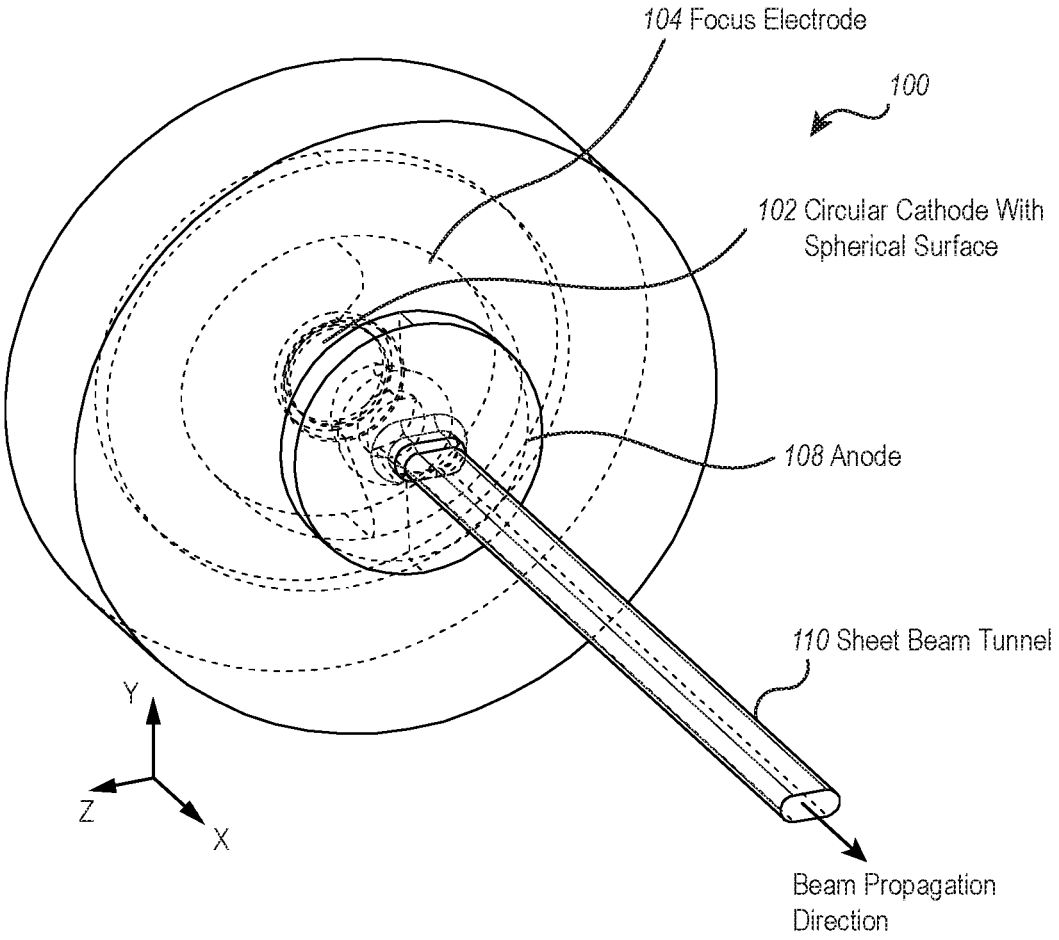
FIG. 1 illustrates an outline drawing of a sheet beam electron gun employing a cathode with a spherical surface and a circular cross-section, where a focus electrode surrounding the cathode has varying focus angles to shape the electron beam.

Embodiments illustrated herein allow for sheet beam formation of a high-quality non-axisymmetric sheet electron beam with beam convergence in both directions orthogonal to the beam propagation direction, while employing a circular cathode with a spherical surface. Such a configuration can be conceptualized as a circular cross-section of a portion of a sphere. Thus, the cathode is not a complete sphere, but has a spherical surface. This cathode type is a standard geometry used in virtually all round-beam vacuum electronics devices whose cathode fabrication and alignment methods are well known.

Asymmetrical sheet beams can be created by using a focus electrode having different focus angles, rather than a single standard Pierce angle for the entire focus electrode. The focus angle is the angle between the normal to the cathode surface at the cathode edge and the focus electrode. For example, the focus angles at the two poles of the polar axis (e.g., the 'top' and 'bottom') of the focus electrode could be the standard Pierce angle of 67.5°, while the two focus angles at the two points of the equatorial axis (e.g., the 'left side' and the 'right side') could be, for example, an angle of 50°. The focus angles of the focus electrode between a polar focus angle and an equatorial focus angle are continuous. For example, the angle of the focus electrode may vary sinusoidally from 50.0° at a polar axis point to 67.5° at either of the two equatorial axis points. This would result in an oblong sheet beam, where one dimension meets certain limitations, such as a limitation with respect to a TWT, and the other dimension can be elongated for various purposes, such as increasing power capacity, or reducing voltage requirements.

For example, some embodiments may be implemented as a TWT device. It may be desirable to limit the beam voltage of the TWT while achieving some appropriate power for the device. For example, it may be desirable to limit the beam voltage of the TWT to 10 kV. Voltages above this level can increase power supply size and weight as well as device voltage standoff requirements. It can also be harmful for certain dielectric materials, emit harmful x-rays, or have other deleterious effects. Embodiments can be constructed so as to shape the electron beam in a TWT to limit the voltage of the TWT to a particular voltage, while achieving higher power through generating an oblong sheet beam.

Embodiments of the invention differ from prior approaches to sheet beam formation in that the cathode in the sheet beam electron gun has a spherical surface and a circular cross section allowing for simple cathode alignment and for use of well-known cathode manufacturing techniques. The gun configuration results in electron beam convergence of two different values in the two directions orthogonal to the beam propagation direction, resulting in a non-axisymmetric sheet beam. Prior approaches employ either an elliptical cathode, which is difficult to manufacture and align, or a rectangular cathode that does not create a beam that converges in one of the orthogonal directions.

Referring now to FIG. 1, one embodiment is illustrated. In the example illustrated in FIG. 1, a sheet beam electron gun 100 using a circular cathode 102 with a spherical surface is shown. This circular cathode 102 has a specially-shaped focus electrode 104 disposed about it, where the focus electrode 104 employs, in this example, two primary focus angles of differing values, with focus angles between the primary focus angles varying. In some embodiments, the angles may vary continuously, such as when the angles vary sinusoidally. In other embodiments, the angle may vary abruptly, such as when a 'v' change occurs.

Figure 2:
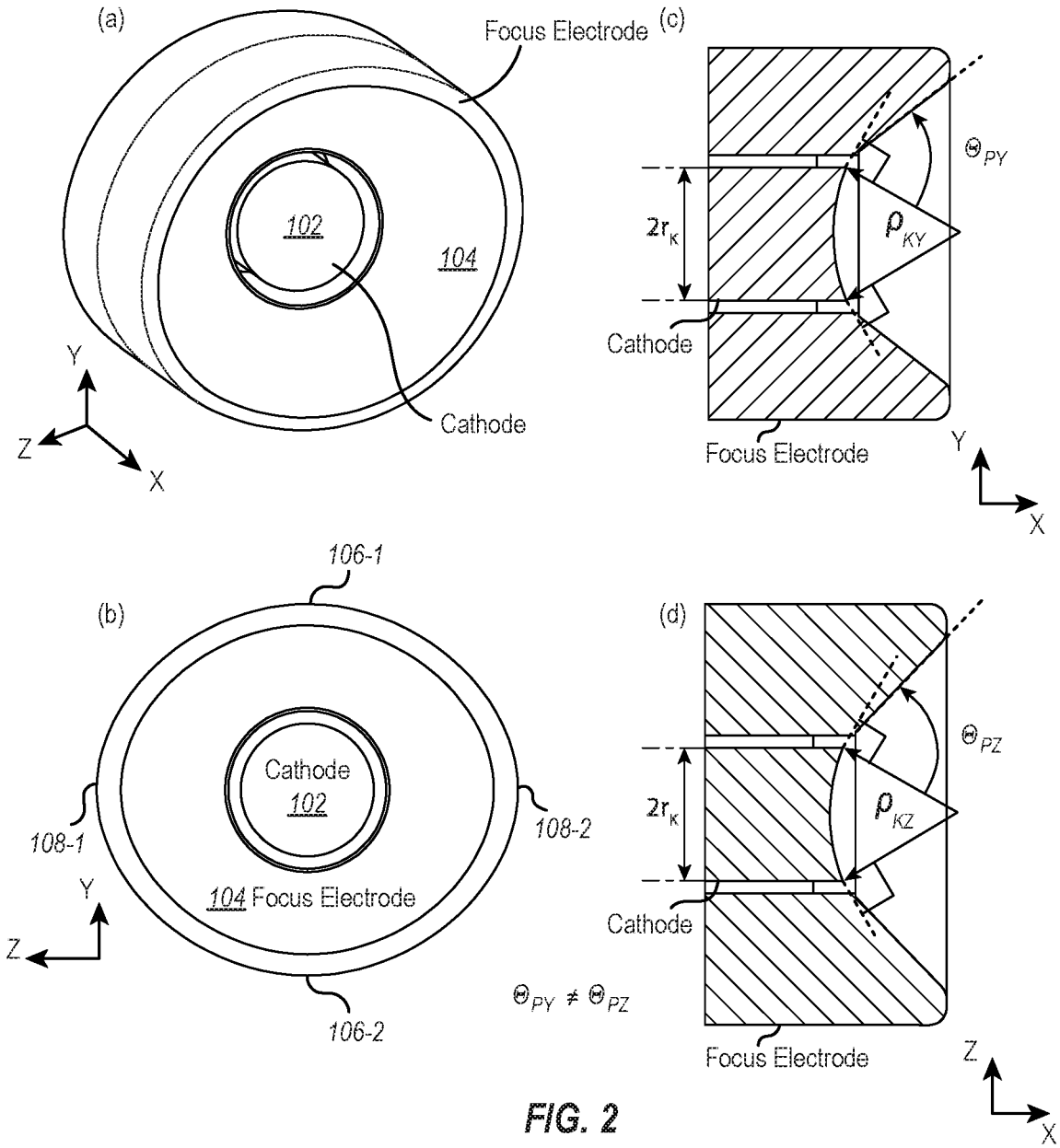
FIG. 2 illustrates various views of a cathode and focus electrode for the sheet beam electron gun employing the circular cathode with spherical surface, and focus electrode using varying focus angles, including an isometric view, a front view, a side view in an X-Y plane, and a side view in an X-Z plane.

For example, with reference to FIG. 2 at (b), a polar point 106-1 and a polar point 106-2 are shown on a polar axis of the focus electrode 104. A first primary focus angle (e.g. 50.0°) may be used on the focus electrode 104 at the polar points 106-1 and 106-2. FIG. 2 at (b) also illustrates that the focus electrode 104 includes equatorial points on an equatorial axis, including equatorial points 108-1 and 108-2. A second primary focus angle (e.g. 67.5°) may be used on the focus electrode 104 at the equatorial points 108-1 and 108-2. The focus angles between the polar points and equatorial points vary. For example, the focus angles along the focus electrode 104 between point 106-1 and point 108-1 may vary between 50° and 67.5° in a continuous fashion. For example, the focus angles may vary linearly between the point 106-1 and point 108-1. Alternatively, or additionally, the angles may vary continuously and sinusoidally between the point 106-1 and the point 108-1. As will be illustrated in more detail below, this results in different compression ratios in different directions resulting in an asymmetrical electron beam sheet.

Returning once again to FIG. 1, an anode 108, either electrically isolated from, or grounded to, the device body helps to form the electric field that extracts the electron beam from the surface of the cathode 102 and focuses the beam into a beam tunnel 110. Azimuthal alignment of the focus electrode 104 with the beam tunnel 110 is made within a reasonable tolerance of no more than five degrees.

Using this approach, the cathode 102 fabrication can use well-known machining techniques and, because the cathode 102 is symmetric around an axis, (i.e. it is a rotatable axisymmetric cathode) rotational alignment is not required. The varying focus angles along the focus electrode 104 create unequal electric field compressive forces in two directions (in the present example) orthogonal to the beam propagation resulting in varying compressions in these two directions.

With appropriate choices of the geometric and electrical (e.g., beam voltage and beam current) parameters for the cathode 102, focus electrode 104, anode 108, and body, (as described above) the axisymmetric electron beam created by the circular cathode 102 transforms into a high-quality non-axisymmetric sheet beam in the beam tunnel 110.

Returning once again to FIG. 2, this figure illustrates the geometry of the cathode and focus electrode that achieves the desired round-to-sheet beam transformation. FIG. 2 at (a) and (b) show an isometric and front view of the cathode 102 and focus electrode 104, respectively. The cathode 102 is circular while the focus electrode 104 has an oblong shape. This shape is a result of the different focus angles used in the two orthogonal directions, Y and Z (and varying between these two directions), of the focus electrode 104 side walls facing the beam. These dual primary focus angles are defined in the XY and XZ cross sections of FIG. 2 at (c) and (d) as the angle between the normal to the cathode edge and the focus electrode wall, and denoted by ΘP Y and ΘP Z. Different than all symmetric Pierce electron guns, ΘP Y does not equal ΘP Z.

In this particular case, ΘP Y=59.5° and ΘP Z=68.0°, the first being significantly different than the classic analytical Pierce angle of 67.5°. However, the cathode 102 of circular shape with radius $r_K$ is seen to be similar to those used in symmetric Pierce electron guns with radii of curvature equal in the two orthogonal directions, i.e., $r_{KY}=r_{KZ}=r_K$.

The effectiveness of this sheet beam gun approach is illustrated in FIGS. 3-6. In these figures, the electron optics solution for the geometries of FIGS. 1 and 2 is shown. The cathode 102 and focus electrode 104 are biased at a negative potential relative to the anode 108 and gun body. For example, the cathode 102 is biased negatively. The focus electrode 104 is usually biased between cathode potential and several volts more negative than cathode potential. The anode 108 is usually biased between ground and cathode potential. The body is at ground potential. For example, the cathode 102 might be biased at minus 10 kV. The focus electrode 104 might be biased at minus 10.010 kV (10V more negative than the cathode 102). The anode 108 might be biased at minus 3 kV. And the body might be biased at 0 V. Space charge limited electron emission is then allowed from the cathode 102 surface creating the electron beam shown as rays in the various figures. Temperature limited or cold emission could also be used in this embodiment.

Figure 3:
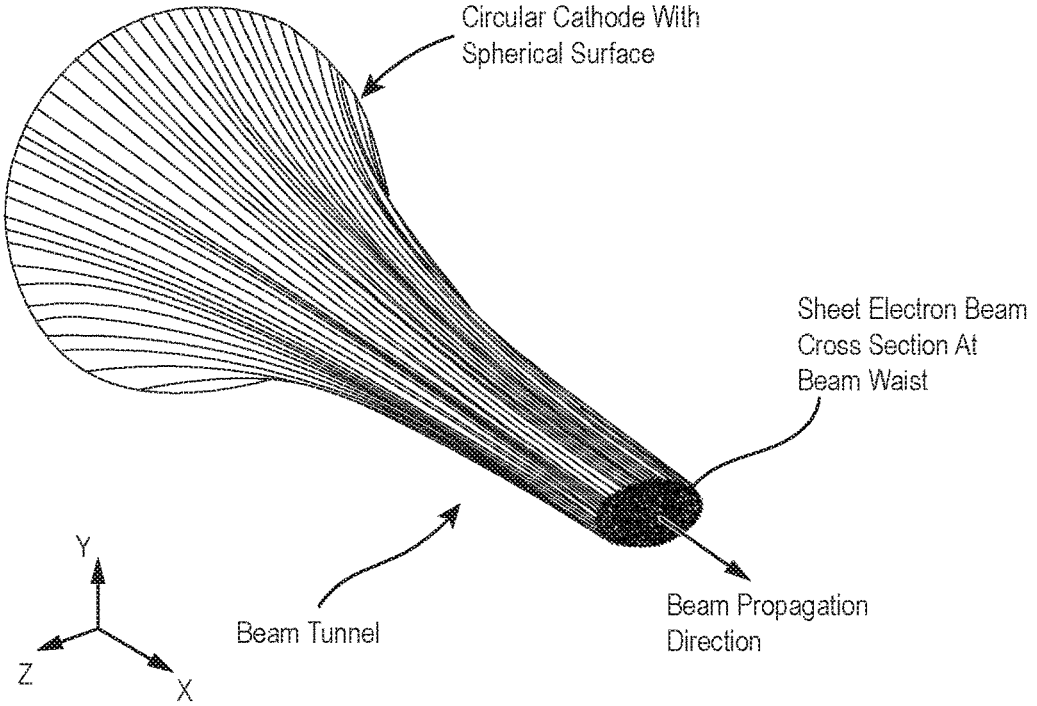
FIG. 3 illustrates an isometric view of asymmetric beam compression showing transformation of the circular beam at a cathode surface into a sheet beam in a beam tunnel at a beam waist showing beam compression.

In FIG. 3, the full set of simulated rays is included in an isometric view, demonstrating the transformation of the circular beam at the cathode 102 surface to the sheet beam in the beam tunnel 110. FIG. 3 shows the well-controlled nature of the beam compression.

Figure 4:
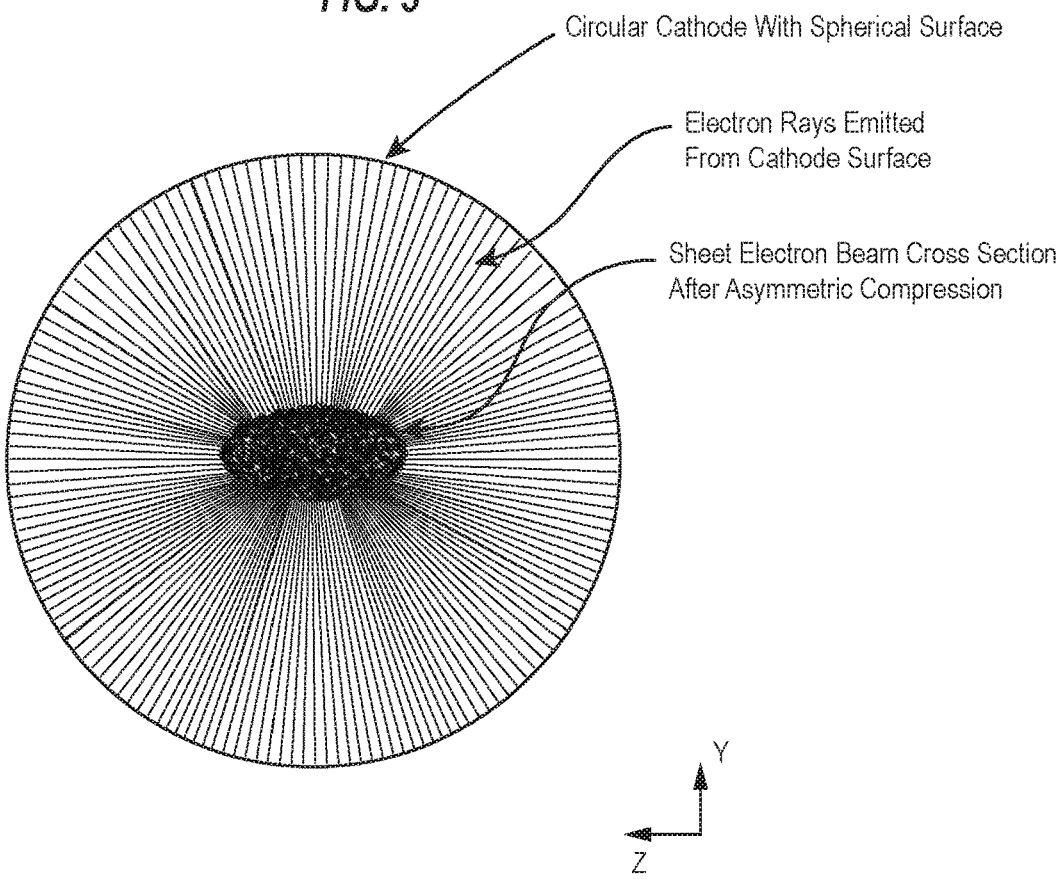
FIG. 4 illustrates another view of an optics simulation shown in FIG. 3 showing the circular cathode emitting rays that converge to a sheet beam geometry, that is elongated in one direction.

FIG. 4 further illustrates the asymmetric compression, showing the end view of the simulation of FIG. 3. Here the circular cathode 102 shape is clearly depicted with the emitted rays traveling radially inward that converge to a sheet beam geometry, that is, an electron beam that is elongated in one direction.

Embodiments illustrated herein can be used to solve the problem of formation of a sheet electron beam, that is, an electron beam whose cross section is not round but elongated in one dimension, without using an asymmetric cathode that is difficult to manufacture and difficult to properly align in a sheet beam electron gun. This results in a beam tunnel cross section that is oblong, as shown, creating an elongated sheet beam transformed from the circular cathode.

Figure 5:
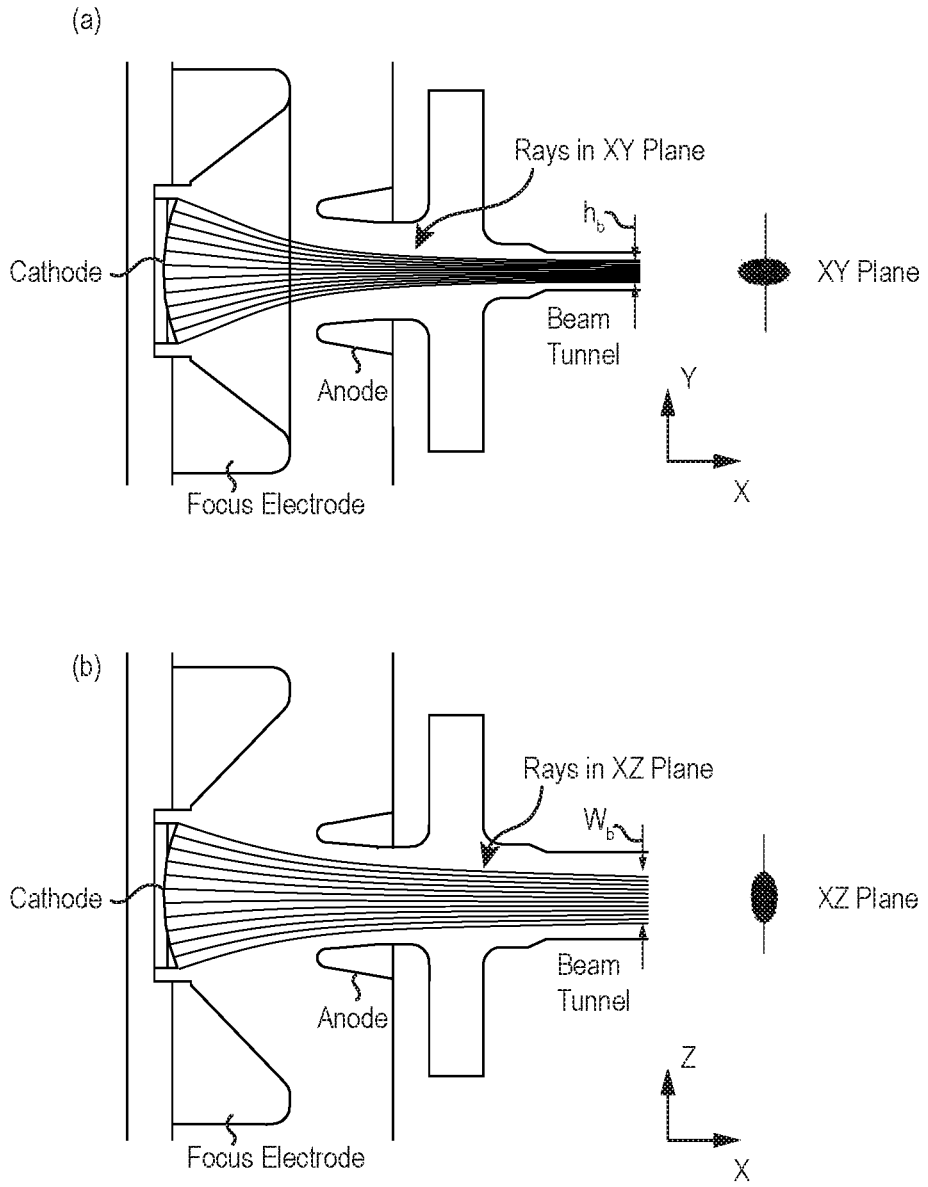
FIG. 5 illustrates the ray paths in the beam center of the XY plane and the XZ plane.

One theoretical problem with such a configuration might be that the varying focus angles would over or under focus the rays at the beam edge creating non-laminarity while leaving the radial compression rates in the beam volume similar in the two orthogonal directions. If this were the case, high-quality capture of the electron beam in a magnetic field would not be possible. FIG. 5 assesses the laminarity of the electron beam by showing rays in the (a) XY plane and (b) XZ plane. The purpose of showing rays in the two planes in this Figure is that the laminarity of the individual rays across the beam volume can be seen. FIG. 5 makes clear that in both of the orthogonal directions, the electron rays remain laminar throughout the full volume as the beam propagates from the cathode 102 surface into the beam tunnel 110. Beam non-laminarity is shown not to be an issue for this sheet beam approach.

Figure 6:
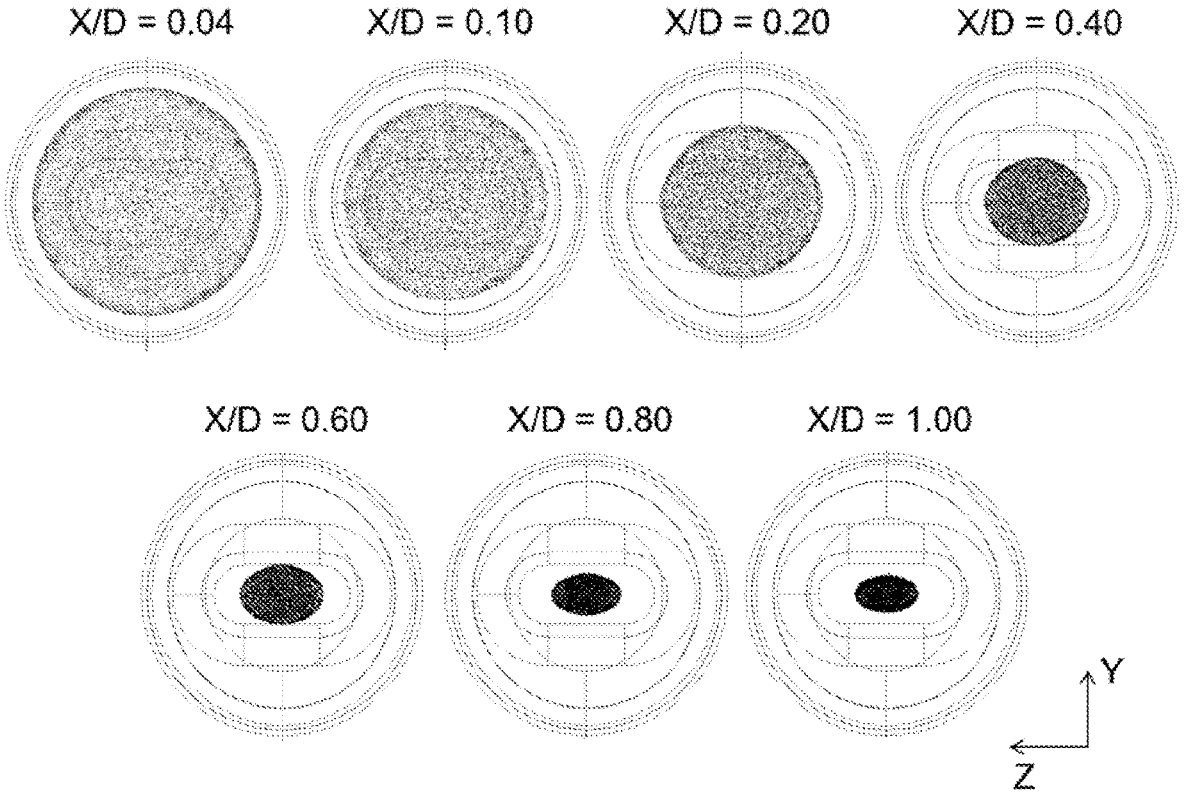
FIG. 6 illustrates an electron optics simulation showing beam cross-sections at various axial distances.

FIG. 6 shows beam cross sections at a series of YZ planes as the beam propagates from the cathode 102 surface into the beam tunnel 110. The beam is seen to start at the cathode 102 surface as a circular beam but compresses at different rates in the two orthogonal directions as it propagates. In particular, FIG. 6 illustrates beam cross sections at axial distance X/D=0.04, X/D=0.10, X/D=0.20, X/D=0.40, X/D=0.60, X/D=0.80, and X/D=1.00, where X=axial position and D=distance from cathode to beam waist. When the beam reaches the beam waist, i.e., the axial location of minimum beam height and width, the circular cross section has been transformed into a sheet beam cross section with the beam height significantly smaller than the beam width. In this case, an aspect ratio of wb/hb=2.5 has been achieved.

There is no known inherent limit to the beam aspect ratio achievable with this compression technique.

Figure 7:
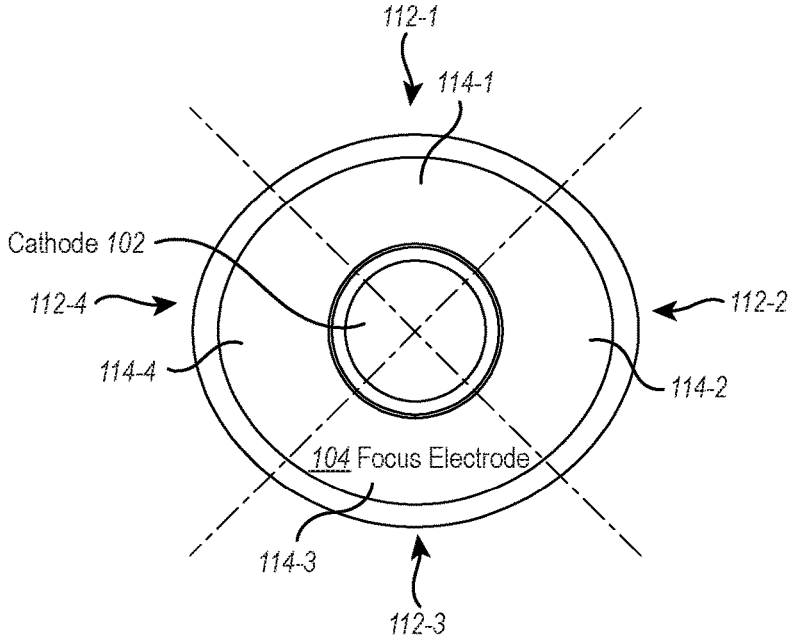
FIG. 7 illustrates the cathode and focus electrode.

Referring now to FIG. 7 various alternatives that can be implemented in various different embodiments of the invention are illustrated. In particular, the focus electrode 104 may be divided into four quadrants 112-1, 12-2, 112-3, and 112-4. Embodiments may be implemented where there are four primary focus angle points, illustrated as 114-1, 114-2, 114-3, and 114-4. Each of the primary focus angle points is implemented on the focus electrode 104 in 1 of the quadrants 112-1 through 112-4. A focus angle point is any point along the focus electrode that has a focus angle. The focus electrode 104 is manufactured such that at least two of the primary focus angle points are different focus angles. Further, the focus angles of the focus electrode 104 vary between any two given primary focus angle points. For example, as described previously, the angle may vary according to a sinusoidal function between any two given primary focus angle points.

Note that the example illustrated in FIGS. 1 through 6 is a special case of the generalized version illustrated in FIG. 7. In particular, the primary focus angle points 114-1 through 114-4 would be distributed every 90° around the focus electrode 104. Primary focus angle points opposing each other (e.g. focus angle points 114-1 and 114-3, or 114-2 and 114-4) are the same angle. Primary focus angle points adjacent each other (e.g. focus angle points 114-1 and 114-2, 114-2 and 114-3, 114-3 and 114-4, or 114-4 and 114-1) are of different angles. Thus, for example focus angle points 114-1 and 114-3 might be 59.5° as illustrated in the example above while focus angle points 114-2 and 114-4 might be 68.0° as illustrated in the example above. In some embodiments, the focus angles may be selected to be between 30° and 80°.

However, embodiments are not limited to simply having the focus angle points vary by 90° from each other. Nor are embodiments limited to having opposite focus angle points be the same angle values.

The following discussion now refers to a number of methods and method acts that may be performed. Although the method acts may be discussed in a certain order or illustrated in a flow chart as occurring in a particular order, no particular ordering is required unless specifically stated, or required because an act is dependent on another act being completed prior to the act being performed.

Figure 8:
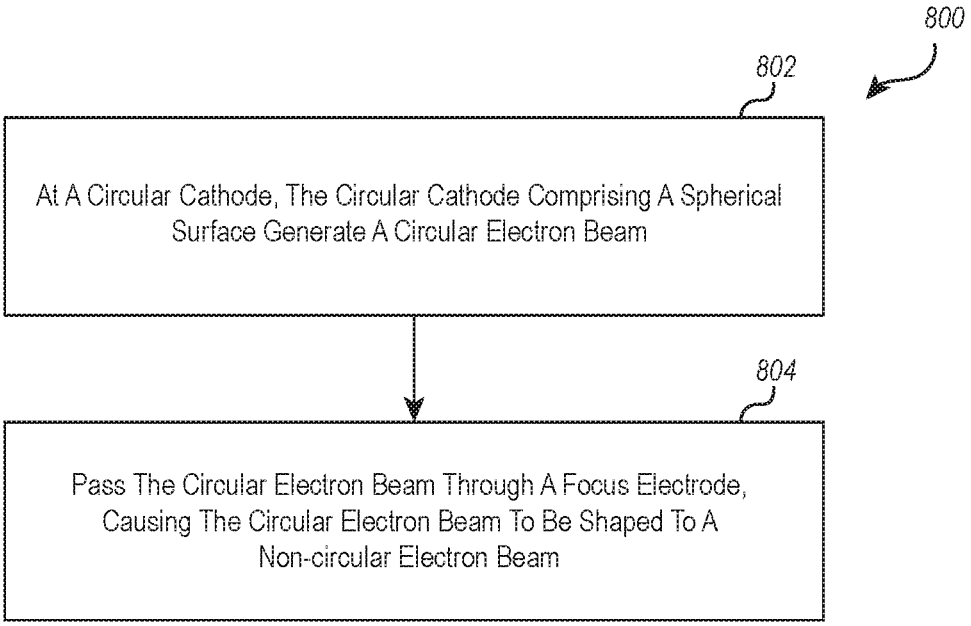
FIG. 8 illustrates a method of generating a sheet beam of electrons.

Referring now to FIG. 8, a method 800 is illustrated. The method 800 is a method of generating a sheet beam of electrons. The method includes at a circular cathode, the circular cathode comprising a spherical surface generating a circular electron beam (act 802). For example, as illustrated in FIG. 1, a circular cross-section electron beam is generated at the circular cathode 102 with a spherical surface.

The method 800 further includes passing the circular electron beam through a focus electrode, causing the circular electron beam to be shaped to a non-circular electron sheet (act 804). For example, the focus electrode 104 causes the circular electron beam to be shaped to a non-circular electron sheet as illustrated by the need for the sheet beam tunnel 110. The focus electrode has four quadrants. An example of this is illustrated in FIG. 7 with the four quadrants 112-1 through 112-4. The focus electrode comprises four primary focus angle points. For example, FIG. 7 illustrates four primary focus angle points 114-1 through 114-4. At least two of the four, adjacent, primary focus angle points have different angle values. For example, focus angle points

114-1 and 114-2 are of different angles, such as 59.5° for one angle and 68.0° for the other angle.

Each of the four primary focus angle points is in a different quadrant. For example, focus angle point 114-1 is in quadrant 112-1 and focus angle point 114-2 is in quadrant 112-2. Focus angles on the focus electrode between any two primary focus angle points vary from one primary focus angle point to another primary focus angle point. For example, a linear, sinusoidal, or other function can be used to identify the angle of the focus electrode between any two primary focus angle points.

In some embodiments of the method 800, passing the circular electron beam through the focus electrode causes the circular electron beam to be shaped to an oblong electron sheet having a second dimension that is larger than a first dimension.

In some embodiments, the oblong electron beam is used to create a microwave signal from an electron beam having a higher current than would be possible to make with an electron beam only having the first dimension. For example, the first dimension may be of a size appropriate for a particular TWT to generate a microwave signal at a particular frequency. If the electron beam was limited to the particular size, then the current may be limited to some particular value at a defined beam voltage. However, by using an oblong beam sheet, where the second dimension is greater than the first dimension, the current can be increased beyond the limit at the same voltage. Alternatively, the oblong electron sheet is used to create a microwave signal from an electron beam having a lower voltage than would be possible to make with an electron sheet only having the first dimension. For example, the first dimension may be of a size appropriate for a particular TWT to generate a microwave signal at a particular frequency. If the electron beam was limited to the particular size, then the voltage may be limited to some particular value at a defined beam current. However, by using an oblong beam sheet, where the second dimension is greater than the first dimension, the voltage can be decreased beyond the limit at the same current.

The method 800 may be practiced where angles between any two primary focus angle points vary linearly from one primary focus angle point to another primary focus angle point.

The method 800 may be practiced where angles between any two primary focus angle points vary sinusoidally from one primary focus angle point to another primary focus angle point.

Figure 9:
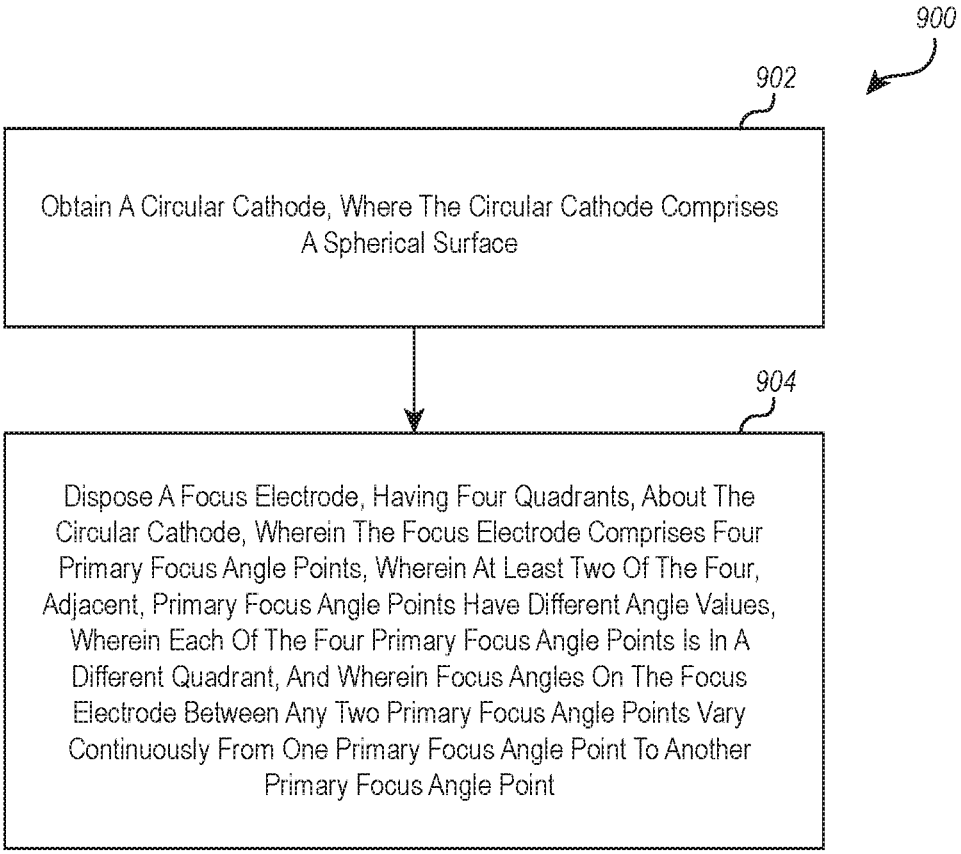
FIG. 9 illustrates a method of making an electron gun.

Referring now to FIG. 9, a method 900 is illustrated. The method 900 includes acts for making an electron gun. The method 900 includes obtaining a circular cathode, where the circular cathode comprises a spherical surface (act 902). For example, a cathode may be obtained in any one of a number of different ways. In one embodiment, a cathode may be obtained from a source that can be manufactured using standard processes to create circular cathodes with spherical surfaces.

The method 900 further includes disposing a focus electrode, having four quadrants, about the circular cathode, wherein the focus electrode comprises four primary focus angle points, wherein at least two of the four, adjacent, primary focus angle points have different angle values, wherein each of the four primary focus angle points is in a different quadrant, and wherein focus angles on the focus electrode between any two primary focus angle points vary from one primary focus angle point to another primary focus angle point (act 904). The FIGS. 1 and 2 discussed above illustrate examples of the results of the method 900.

The method 900 may further include forming angles between any two primary focus angle points such that the angles vary linearly from one primary focus angle point to another primary focus angle point.

The method 900 may further include forming angles between any two primary focus angle points such that the angles vary sinusoidally from one primary focus angle point to another primary focus angle point.

Other angle variation may be implemented in other embodiments.

The method 900 may be practiced where a first primary focus angle point is at a first pole of the focus electrode, a second primary focus angle point is at an opposite, second pole of the focus electrode, a third primary focus angle point is at a first equatorial point of the focus electrode, and a fourth primary focus angle point is at second equatorial point of the focus electrode, opposite the first equatorial point of the focus electrode.

The method 900 may further include forming the first and second primary focus angle points to have an angle of 59.5°.

The method 900 may further include comprising forming the third and fourth primary focus angle points to be at an angle of 68.0°.

The present invention may be embodied in other specific forms without departing from its spirit or characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An electron gun comprising:

a circular cathode, wherein the circular cathode comprises a spherical surface;

a focus electrode, having four quadrants, disposed about the circular cathode, wherein the focus electrode comprises four primary focus angle points, wherein at least two of the four, adjacent, primary focus angle points have different angle values, wherein each of the four primary focus angle points is in a different quadrant, and wherein focus angles on the focus electrode between any two primary focus angle points vary from one primary focus angle point to another primary focus angle point.

2. The electron gun of claim 1, wherein angles between any two primary focus angle points vary linearly from the one primary focus angle point to the another primary focus angle point.

3. The electron gun of claim 1, wherein angles between any two primary focus angle points vary sinusoidally from the one primary focus angle point to the another primary focus angle point.

4. The electron gun of claim 1, wherein a first primary focus angle point is at a first pole of the focus electrode, a second primary focus angle point is at an opposite, second pole of the focus electrode, a third primary focus angle point is at a first equatorial point of the focus electrode, and a fourth primary focus angle point is at second equatorial point of the focus electrode, opposite the first equatorial point of the focus electrode.

5. The electron gun of claim 4, wherein the first and second primary focus angle points are at an angle of 59.5°.

6. The electron gun of claim 4, wherein the third and fourth primary focus angle points are at an angle of 68.0°.

7. The electron gun of claim 1, wherein the primary focus angle points are at angles selected to create an electron beam of a predetermined aspect ratio in order to generate a predetermined power of a microwave signal output from a TWT using an electron beam of the electron gun.

8. The electron gun of claim 1, wherein the primary focus angle points are at angles selected to create an electron beam of a predetermined aspect ratio in order to operate at a predetermined voltage to generate a microwave signal output from a TWT using an electron beam of the electron gun.

9. A method of generating a sheet beam of electrons, the method comprising:

at a circular cathode, the circular cathode comprising a spherical surface generating a circular electron beam;

passing the circular electron beam through a focus electrode, the focus electrode having four quadrants, wherein the focus electrode comprises four primary focus angle points, wherein at least two of the four, adjacent, primary focus angle points have different angle values, wherein each of the four primary focus angle points is in a different quadrant, and wherein focus angles on the focus electrode between any two primary focus angle points vary from one primary focus angle point to another primary focus angle point, causing the circular electron beam to be shaped into a non-circular electron sheet.

10. The method of claim 9, wherein passing the circular electron beam through the focus electrode causes the circular electron beam to be shaped into an oblong electron sheet having one dimension that is larger than a first dimension.

11. The method of claim 10, wherein the oblong electron sheet is used to create an electron beam having a higher current than would be possible to make with an electron beam at the same voltage only having the first dimension.

12. The method of claim 10, wherein the oblong electron sheet is used to create an electron beam having a lower voltage than would be possible to make with an electron beam at the same current only having the first dimension.

13. The method of claim 9, wherein angles between any two primary focus angle points vary linearly from one primary focus angle point to another primary focus angle point.

14. The method of claim 9, wherein angles between any two primary focus angle points vary sinusoidally from one primary focus angle point to another primary focus angle point.

15. A method of making an electron gun, the method comprising:

obtaining a circular cathode, wherein the circular cathode comprises a spherical surface;

disposing a focus electrode, having four quadrants, about the circular cathode, wherein the focus electrode comprises four primary focus angle points, wherein at least two of the four, adjacent, primary focus angle points have different angle values, wherein each of the four primary focus angle points is in a different quadrant, and wherein focus angles on the focus electrode between any two primary focus angle points vary from one primary focus angle point to another primary focus angle point.

16. The method of claim 15, further comprising, forming angles between any two primary focus angle points such that the angles vary linearly from one primary focus angle point to the another primary focus angle point.

17. The method of claim 15, further comprising, forming angles between any two primary focus angle points such that the angles vary sinusoidally from the one primary focus angle point to another primary focus angle point.

18. The method of claim 15, wherein a first primary focus angle point is at a first pole of the focus electrode, a second primary focus angle point is at an opposite, second pole of the focus electrode, a third primary focus angle point is at a first equatorial point of the focus electrode, and a fourth primary focus angle point is at second equatorial point of the focus electrode, opposite the first equatorial point of the focus electrode.

19. The method of claim 18, further comprising forming the first and second primary focus angle points to have an angle of 59.5°.

20. The method of claim 18, further comprising forming the third and fourth primary focus angle points to be at an angle of 68.0°.

* * * * *